US007641173B2

(12) United States Patent
Goodman

(10) Patent No.: US 7,641,173 B2
(45) Date of Patent: Jan. 5, 2010

(54) FAUCET WITH AUTOMATIC TEMPERATURE CONTROL AND METHOD

(76) Inventor: Matthew Philip Goodman, 20905 NW. Rock Creek Blvd., Portland, OR (US) 97229

( * ) Notice: Subject to any disclaimer, the term of this patent is extended or adjusted under 35 U.S.C. 154(b) by 283 days.

(21) Appl. No.: 11/626,323

(22) Filed: Jan. 23, 2007

(65) Prior Publication Data

US 2007/0170384 A1 Jul. 26, 2007

Related U.S. Application Data

(60) Provisional application No. 60/761,985, filed on Jan. 23, 2006.

(51) Int. Cl.
*F16K 31/02* (2006.01)

(52) U.S. Cl. ..... 251/129.04; 4/623

(58) Field of Classification Search ..... 251/129.04; 4/623

See application file for complete search history.

(56) References Cited

U.S. PATENT DOCUMENTS 3,151,340 A 10/1964 Teshima
4,741,363 A 5/1988 Hu
4,941,219 A 7/1990 Van Marcke
5,025,516 A 6/1991 Wilson
5,062,164 A 11/1991 Lee et al.
5,855,356 A * 1/1999 Fait ..... 251/129.04
5,868,311 A * 2/1999 Cretu-Petra ..... 236/12.12
6,192,530 B1 2/2001 Dai
6,202,980 B1 * 3/2001 Vincent et al. ..... 251/129.04
6,321,785 B1 * 11/2001 Bergmann ..... 137/606
6,913,203 B2 7/2005 DeLangis
6,962,168 B2 11/2005 McDaniel et al.
6,968,860 B1 11/2005 Haenlein et al.

* cited by examiner

*Primary Examiner*—John K Fristoe, Jr.
(74) *Attorney, Agent, or Firm*—Christopher D. Goodman

(57) ABSTRACT

Embodiments of the present invention provide a faucet having a first sensing arrangement adapted to detect a presence of one or more objects, in a first predetermined region, and adapted to turn a fluid flow on when the one or more objects is present, and further adapted to turn the flow off when the object is removed. Embodiments also include a second sensing arrangement adapted to detect a presence and/or a movement of one or more objects, in a second predetermined region and adapted to adjust a temperature of the fluid based on the presence, or movement of the one or more objects.

12 Claims, 5 Drawing Sheets

FAUCET WITH AUTOMATIC TEMPERATURE CONTROL AND METHOD

CROSS REFERENCE TO RELATED APPLICATIONS

The present application claims priority to U.S. Provisional Patent Application No. 60/761,985, filed Jan. 23, 2006 entitled "FAUCET TEMPERATURE CONTROL APPARATUS," the entire disclosure of which is hereby incorporated by reference in its entirety.

TECHNICAL FIELD

Embodiments of the present invention relate to the field of automatic faucets and, more specifically, to a faucet having an automated turn on feature, and an automatic temperature control apparatus, system and a method.

BACKGROUND

Faucets which automatically turn on when a person places their hands in close proximity to the faucet, and off when the person removes their hands from the close proximity are known and have been installed in millions bathrooms, restrooms and washrooms. However, the temperature at which the water flows from the faucet is a preset temperature determined by, for example, the faucet manufacturer, installer of the faucet, maintenance personnel, a plumber, or the like. A person using the faucet may prefer the water be a temperature that is different from the preset temperature.

BRIEF DESCRIPTION OF THE DRAWINGS

Embodiments of the present invention will be readily understood by the following detailed description in conjunction with the accompanying drawings. Embodiments of the invention are illustrated by way of example and not by way of limitation in the figures of the accompanying drawings.

DETAILED DESCRIPTION OF EMBODIMENTS OF THE INVENTION

In the following detailed description, reference is made to the accompanying drawings which form a part hereof, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Various operations may be described as multiple discrete operations in turn, in a manner that may be helpful in understanding embodiments of the present invention; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments of the present invention.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" means A or B. For the purposes of the description, a phrase in the form "A and/or B" means "(A), (B), or (A and B)". For the purposes of the description, a phrase in the form "at least one of A, B, and C" means "(A), (B), (C), (A and B), (A and C), (B and C), or (A, B and C)". For the purposes of the description, a phrase in the form "(A)B" means "(B) or (AB)" that is, A is an optional element.

The description may use the phrases "in an embodiment," or "in embodiments," which may each refer to one or more of the same or different embodiments. Furthermore, the terms "comprising," "including," "having," and the like, as used with respect to embodiments of the present invention, are synonymous.

In various embodiments of the present invention, methods, apparatuses, and systems for controlling the flow of one or more fluids are provided. In exemplary embodiments of the present invention, a computing system may be endowed with one or more components of the disclosed apparatuses and/or systems and may be employed to perform one or more methods as disclosed herein.

Figure 1:
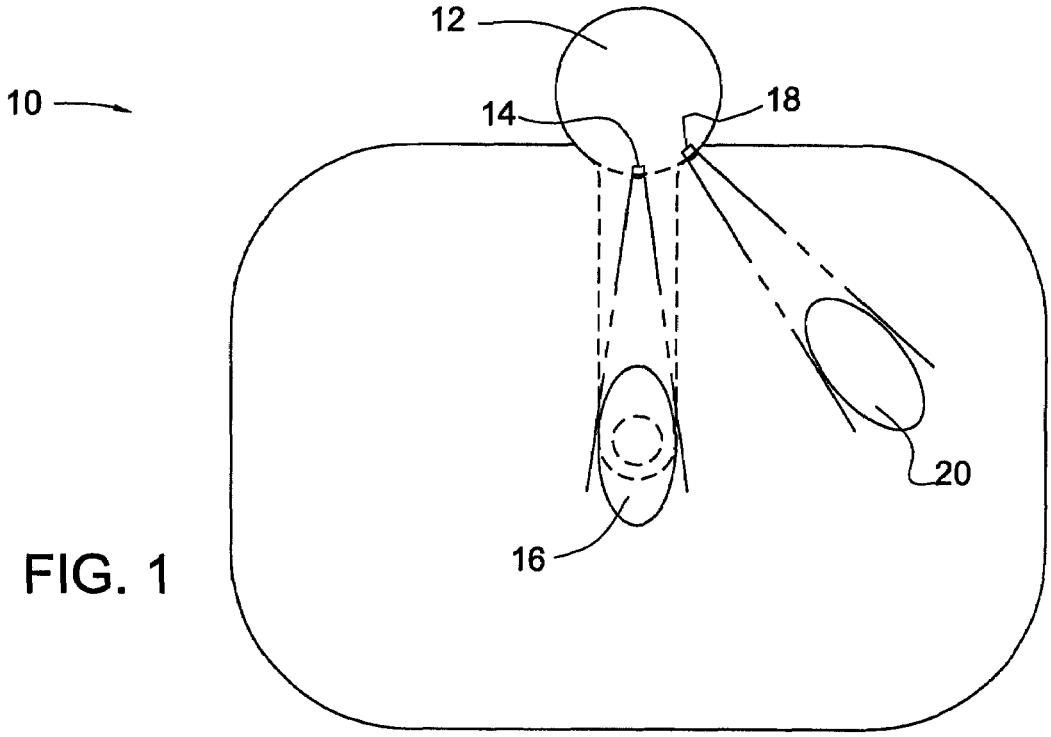
FIG. 1 illustrates a top partially schematic view in accordance with various embodiments of the present invention.

FIG. 1 is a top view illustrating various embodiments according to the invention. A faucet 10 may include a faucet body 12 having an internal passage (not shown) for passing a fluid from a fluid source such as a plumbing system in a building. The faucet body 12 may include a first sensing arrangement 14 adapted to detect a presence of one or more objects, for example a person's hand, or hands, in a first predetermined region 16, and may be adapted to turn a fluid flow on when the object is present, and may be adapted to turn the flow off when the object is removed. The condition, or characteristics of the fluid, such as temperature may be at a starting, or default condition, that may be set by an operator using a control module when it first flows from faucet 10. For example the fluid may be water that starts flowing at a warm, i.e. starting, temperature. A second sensing arrangement 18 may be adapted to detect a presence and/or a movement of one or more objects, for example, a person's hand, or hands, in a second predetermined region 20, and may be adapted to adjust the characteristics of the fluid based on the presence, or based on movement of the object. Various embodiments may be adapted to adjust the characteristics of the fluid based on a movement of the one or more objects. For example based on the rate, or direction, of movement.

As stated the one or more objects may be one or both of a user hands. It will be understood that the one or more objects could be a first hand in the first predetermined region and the one or more objects could also be a second hand in the second predetermined region. In other words in some cases two different objects may be considered the one or more objects that may effect control of the flow of a fluid in accordance with various embodiments of the invention.

Figure 2:
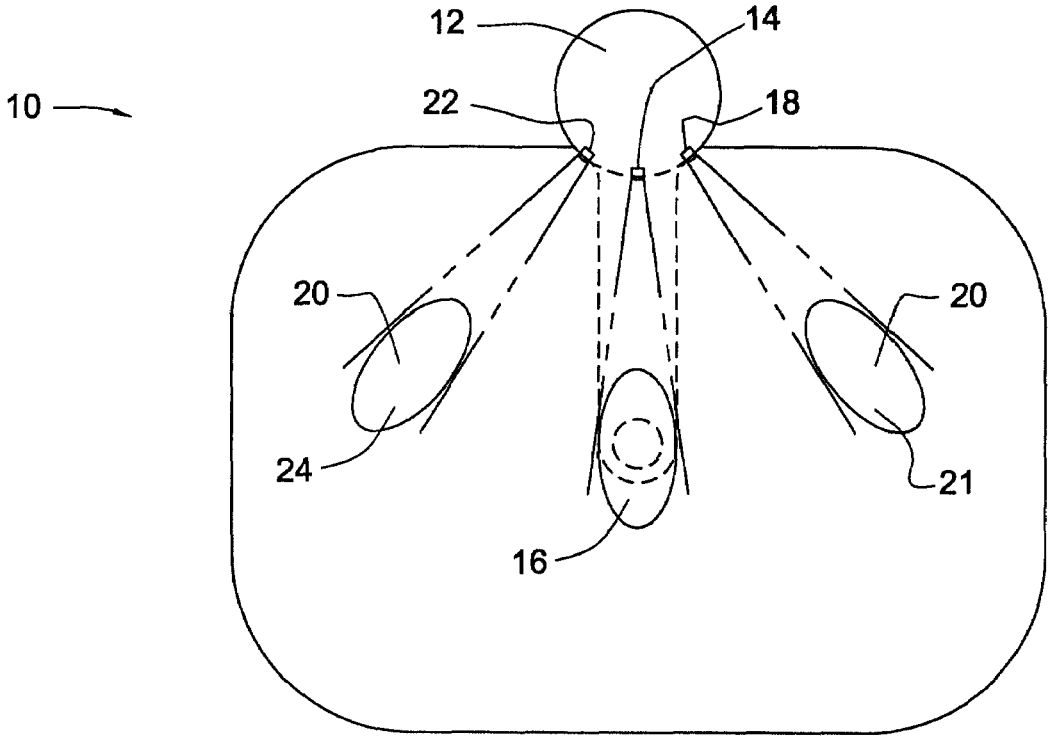
FIG. 2 illustrates a top partially schematic view in accordance with various embodiments of the present invention.

FIG. 2 is a top view illustrating various embodiments according to the invention. The illustrated embodiments may include a second predetermined 20 region which may be a split region having a sub region 21 adapted to increase the temperature of the fluid upon detecting the presence of an object in the first sub region 21, and having a second part 24 adapted to decrease the temperature of the fluid upon detecting the presence of an object in the second sub region 22.

Figure 3:
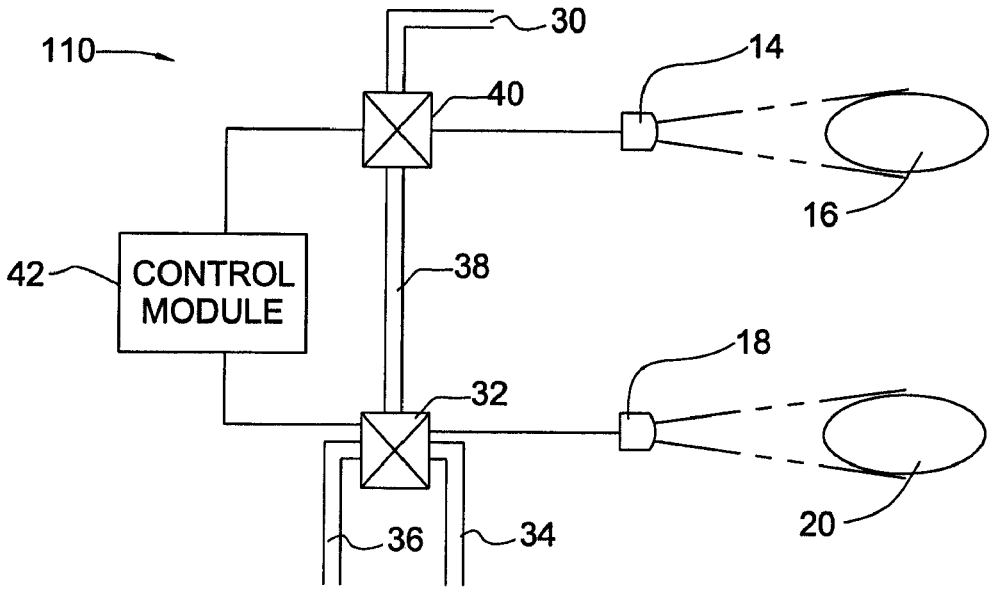
FIG. 3 illustrates a schematic view in accordance with various embodiments of the present invention.

FIG. 3 is a schematic view of various embodiments according to the invention. A water delivery arrangement 110 may include an outlet 30 for outputting a mixed flow. A mixing valve 32 may be coupled with a hot water supply 34, and may be further coupled with a cold water supply 36. The mixing valve 32 may be for mixing relative amounts of hot water and cold water, and thereby changing the temperature of a mixed flow. The mixing valve 32 may also be coupled with the outlet 30 via a mixed supply line 38 for supplying the mixed flow to the outlet 30. A main flow valve 40 may be disposed between the outlet 30 and the mixing valve 32 and adapted to open to allow water to flow from the mixing valve to the outlet. The main flow valve 40 may also be disposed to close to prevent flow to the outlet 30. A first sensing arrangement 14 for detecting the presence of an object in a first detection zone 16 may be operatively coupled to the main flow valve 40 for effecting the opening and the closing of the main flow valve 40. A second sensing arrangement 18 may be adapted to detect the presence of the object, or another object, in a second detection zone 20, and may be operatively coupled with the mixing valve to effect the mixing of the relative amounts.

In various embodiments the water delivery arrangement 110 may further include a control module 42 which may be coupled with the mixing valve 32 and the main flow valve 32 for controlling one or more operating conditions of the water delivery arrangement 110. The operating conditions may be one or more from the group consisting of: a default temperature, a maximum temperature, a minimum time for the main flow valve 40 to remain open to allow water to flow to the outlet 30 upon detection of the presence of the one or more objects, and a maximum time for the main flow valve to remain open which may prevent wasting water.

In various embodiments the temperature of the fluid may be adjusted by, for example, mixing a source of hot fluid and a source of cold fluid in differing amounts thereby adjusting the temperature of a mixed flow. In various embodiments the fluid may be water, for example. The faucet may be disposed to flow into a basin or sink. In various embodiments various sensors may be proximity sensors, and may use various technologies including but not limited to infrared, electromagnetic, body heat detection and the like. In various embodiments the fluid temperature may be adjusted by predetermined increments. In other embodiments temperature adjustment may be continuous. In various embodiments the temperature may be limited to a predetermined maximum temperature, limited by factors including but not limited to, environmental, cost or safety factors.

Figure 4:
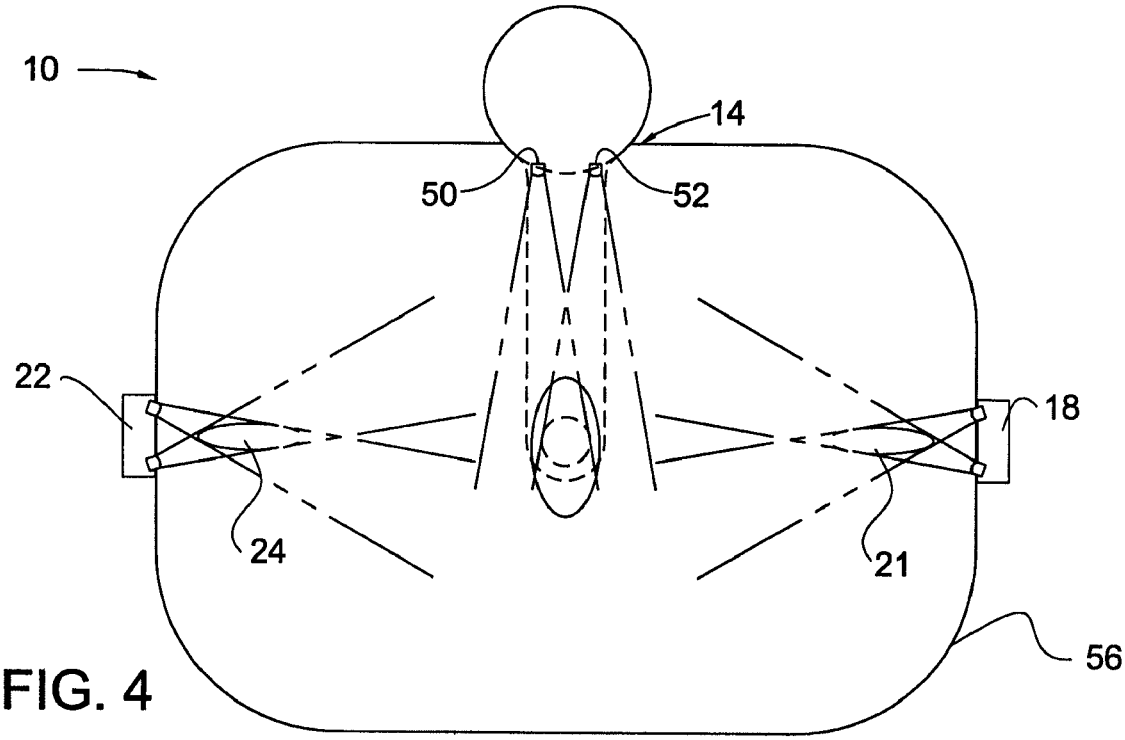
FIG. 4 illustrates a top partially schematic view in accordance with various embodiments of the present invention.

FIG. 4 is a top view illustrating various embodiments according to the invention. A faucet 10 may include a first sensing arrangement 14 for turning flow, of a fluid, on or off, which may utilize a valve (not shown) as described with other embodiments. The first sensing arrangement 14 may be a proximity sensor and may include an emitter 50 and a receiver 52 adapted to detect one or more objects in a first predetermined region 16. One or both of the emitter 50 and receiver 52 may be adapted to be adjusted such that the location of the first predetermined region 16 may be adjusted. The faucet 10 may also include a second sensing arrangement which may be for example a first proximity sensor 18 and a second proximity sensor 22. The first proximity sensor 18 may coupled with a mixing valve (not shown) and may be adapted to adjust the mixing valve such that the fluid will increase in temperature upon sensing an object in a first sub region 21. The second proximity sensor 22 may be coupled with the mixing valve and may be further adapted to adjust the mixing valve such that the fluid will decrease in temperature upon sensing an object in a second sub region 24. The first proximity sensor 18 may be located at a first side of a basin 56. The basin may be disposed to receive the fluid. The second proximity sensor 22 may be located at a second side of the basin 56. Other locations are possible.

In such embodiments a person may approach the basin 56, and put one or both hands under the faucet 10 to turn the water on. The water may begin to flow at a starting, or default, temperature. Then with the flow started the user may move one, hand near the first proximity sensor 18 to warm the water up, or move one hand near the second proximity sensor 22 to cool the water down. In various embodiments the rate of warming or cooling may be determined by the amount of time the user's hand is near the first or second proximity sensors 18/22. In various other embodiments warming or cooling may be determined by the user moving his or her hand. In one embodiment the rate of warming or cooling maybe determined by the rate at which a user moves his or her hand. In various embodiments if the user removes the hand from under the faucet for a predetermined length of time the temperature of the flow may be reset to the starting or default temperature. The flow may also stop. The predetermined length of time and the default temperature may be considered operating conditions and may be adjustable. Other operating conditions may also be adjustable.

Figure 5:
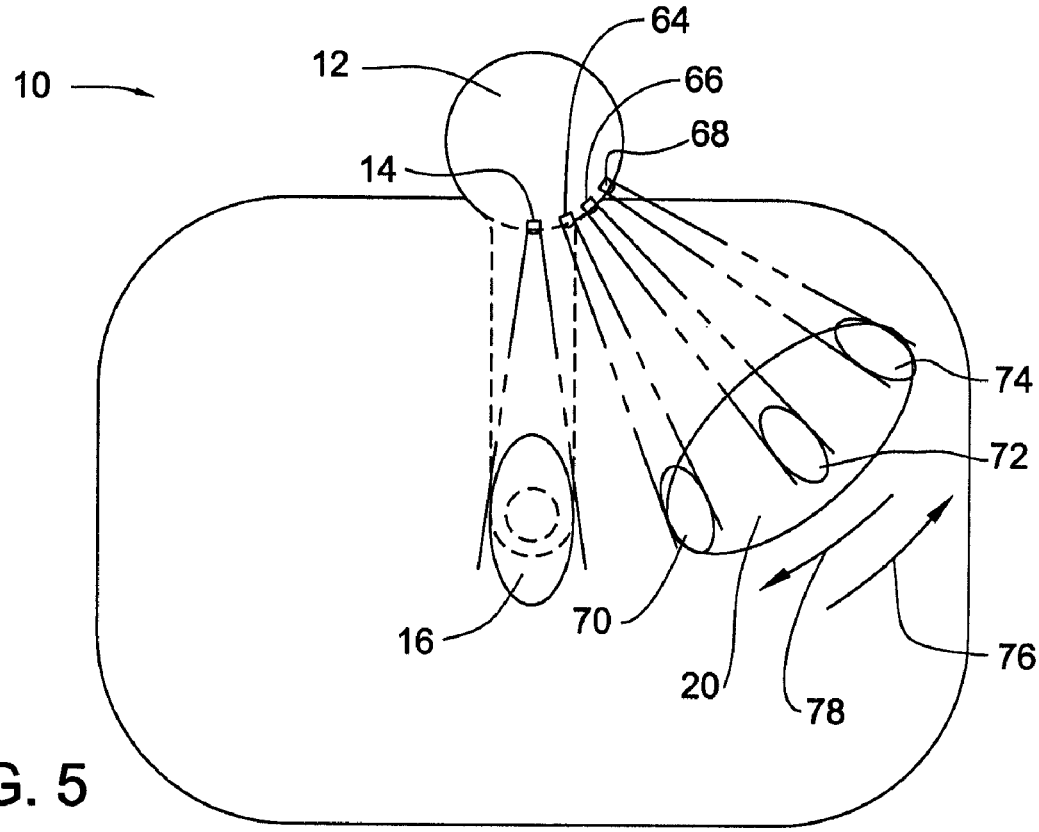
FIG. 5 illustrates a top partially schematic view in accordance with various embodiments of the present invention.
Figure 6:
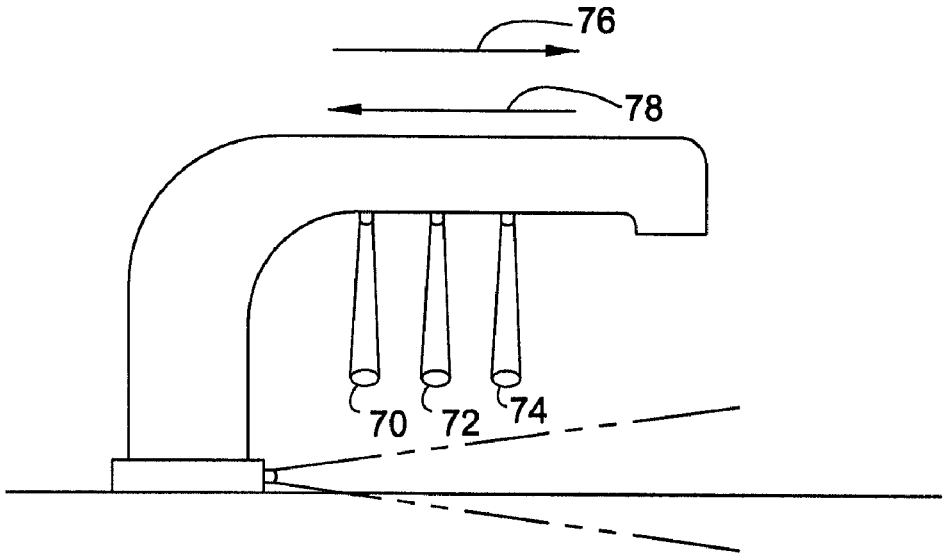
FIG. 6 illustrates a side view in accordance with various embodiments of the present invention.
Figure 7:
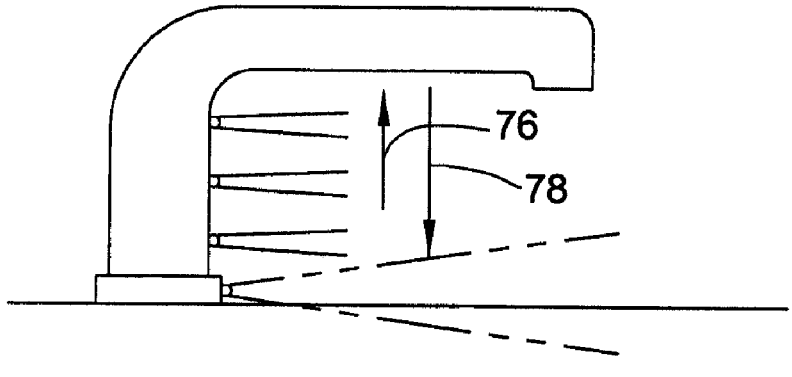
FIG. 7 illustrates a side view in accordance with various embodiments of the present invention.
Figure 8:
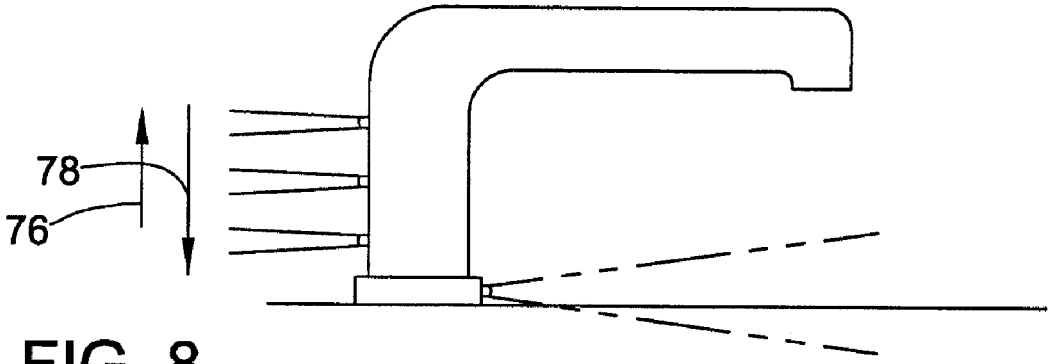
FIG. 8 illustrates a side view in accordance with various embodiments of the present invention.
Figure 9:
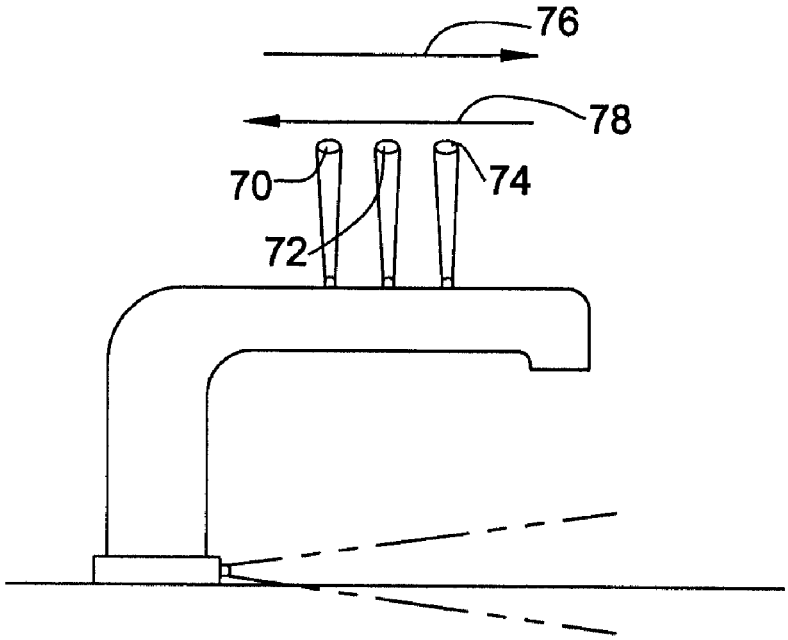
FIG. 9 illustrates a top partially schematic view in accordance with various embodiments of the present invention.

FIG. 5 is a top view illustrating one embodiment according to the invention. A fluid temperature control apparatus 10 may include a first sensor 14 adapted to detect a presence of one or more objects, for example a person's hand, or hands, in a first predetermined region 16, and may be adapted to turn a fluid flow on when the object is present, and may be adapted to turn the flow off if the object is removed. The fluid temperature control apparatus 10 may also include a second sensing arrangement 12 which may include a number of sensors, for example three 64, 66, and 68 which may be adapted to detect a presence of one or more objects, for example a person's hand, or hands, in a second predetermined region 20. The second predetermined region 20 may include a number of sub regions, for example three sub regions 70, 72, and 74 which may be adapted such that if an object is moved in a first direction 76 the temperature of the fluid may increase, and if the object is moved in a second direction 78 the temperature of the fluid may decrease. In various embodiments a maximum temperature may be achieved upon a single pass across the sub regions 70/72/74 in the first direction 30, and in various embodiments minimum temperature may be achieved upon a single pass across the sub regions 70/72/74 in the second direction 78. In various other embodiments the temperature of the mixed flow may be gradually increased with each pass across the sub regions 70/72/74 in the first direction 76, and the temperature of the mixed flow may be gradually decreased with each pass across the sub regions 70/72/74 in the second direction 78. Various embodiments may have various numbers of sub regions.

FIGS. 6-9 are side views illustrating various embodiments according to the invention, wherein the second predetermined region may include a number of sub regions disposed in various locations. For example, three sub regions 70, 72, and 74 may be respectively located: in a horizontal line below the faucet head; in a vertical line below the faucet head; in a vertical line in a rear portion of the faucet; in a horizontal line on a top of the faucet head. Other embodiments may have a second predetermined region in other locations, some with multiple sub regions, some without sub regions. The three sub regions 70, 72, and 74 may be adapted such that if an object is moved in a first direction 76 the temperature of the fluid may increase, and if the object is moved in a second direction 78 the temperature of the fluid may decrease. In various embodiments a maximum temperature, may be achieved upon a single pass, or upon multiple passes across the sub regions 70/72/74 in the first direction 76, and in various embodiments a minimum temperature may be achieved upon a single pass, or upon multiple passes, across the sub regions 70/72/74 in the second direction 78. Various embodiments may have various numbers of sub regions. It will be understood that with various embodiments the rate of movement of an object may affect a rate of temperature change.

Figure 10:
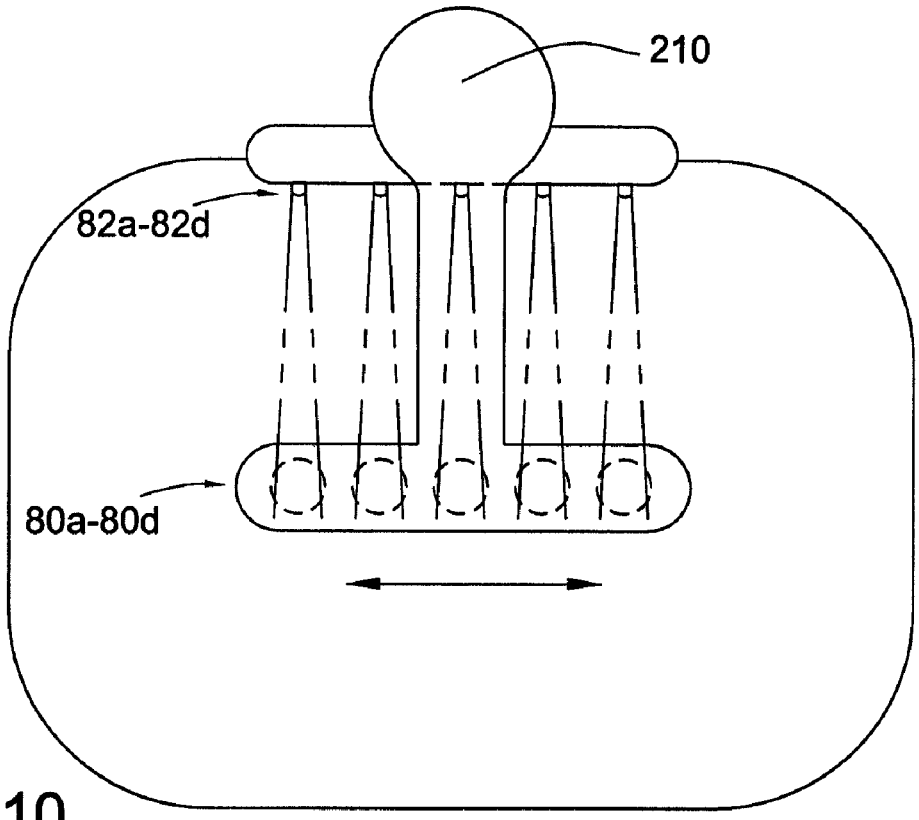
FIG. 10 illustrates a top partially schematic view in accordance with various embodiments of the present invention.

FIG. 10 is a top views illustrating various embodiments according to the invention, wherein a faucet 210 may be adapted to have a number of outlets 80*a*-80*e*, for example five. The same number of sensors 82*a*-82*e* may be adapted to detect when an object, such as a persons hand is under each respective outlet 80*a*-80*e*. The respective outlet may then provide a flow of fluid having a respecting predetermined characteristic, such as temperature.

Figure 11:
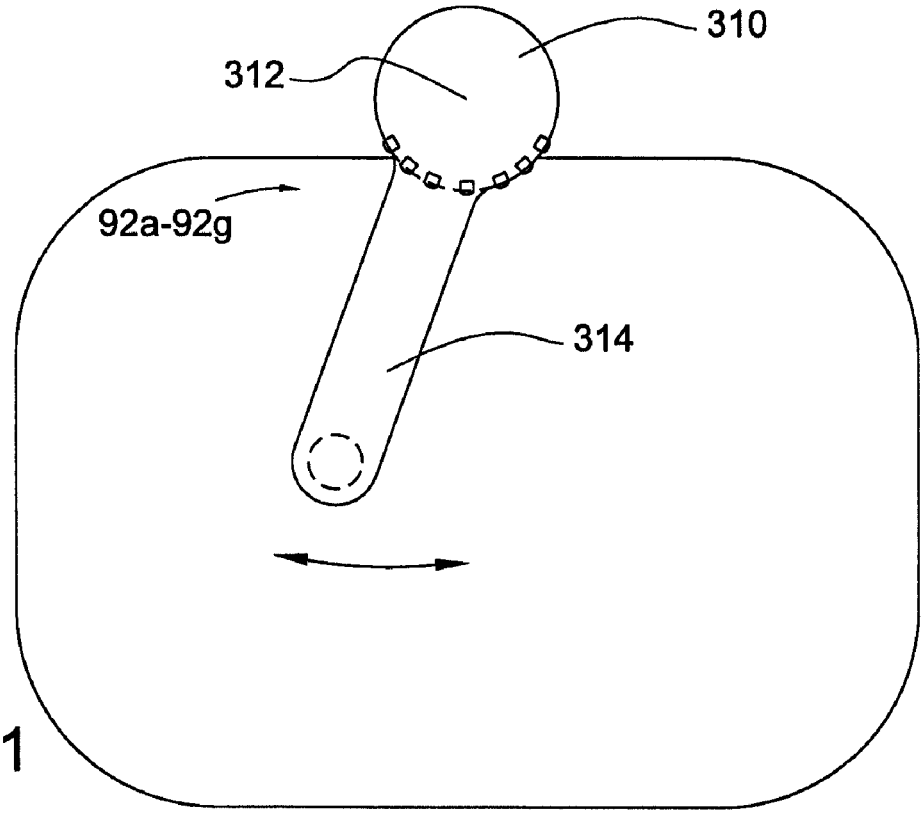
FIG. 11 illustrates a top partially schematic view in accordance with varies embodiments of the present invention.

FIG. 11 is a top views illustrating various embodiments according to the invention, wherein a faucet 310 may be adapted to have a number of sensors 92*a*-92 *g*, for example seven. The sensors 92*a*-92*g* may be adapted to detect when an object, such as a persons hand is in a predetermined angular relationship with a faucet center 312. A faucet arm 314 may then pivot and track the movement of the object. The characteristics of the flow, such as temperature, may change in accordance with the angular position of the faucet arm 314. In various other embodiments, an outlet may be pivotally coupled with a faucet arm, and disposed to pivot about an axis that passes substantially through the faucet arm. In this way the outlet may then pivot and track the movement of an object, such as a user's hands. The characteristics of the flow, such as temperature, may change in accordance with the angular position of the outlet.

In various embodiments according to the invention a faucet may be adapted such that upon an object being positioned in a second predetermined region the temperature of the fluid may change, and upon the object being removed the temperature of the fluid will return to a default or predetermined temperature. For, example a user of various embodiments according to the invention may place one or both hands in a first predetermined region, to turn a flow on which may start at a default or starting temperature. Then the user may place a hand in a second predetermined region to increase the temperature. Upon removing the hand from the second predetermined region the temperature may one of: stay at the adjusted temperature; gradually decrease to the default temperature; or rapidly, and/or immediately decrease to the default temperature. In various embodiments the temperature of the fluid may change by a predetermined amount depending on a length of time an object is in a second region.

Various embodiments in accordance with the invention may include a method including:

reacting to a presence of one or more objects within a first detection zone of a first sensing arrangement by opening a first valve and allowing a mixed fluid to flow;

sensing the presence of the one or more objects in a second detection zone; and adjusting a mixing valve based on the presence of the one or more objects to adjust relative components of the mixed fluid to change at least one characteristic of the mixed fluid.

With various embodiments the method the mixed fluid may be water and the at least one characteristic is the temperature of the water. Or in various other embodiments the least one characteristic is one from the group consisting of:

sweetness, bitterness, caffeine content, alcohol content, acidity, alkalinity and the like. Various embodiments may be used to adjust concentrations of dry or powered materials.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

What is claimed is:

1. A faucet comprising:

a first sensing arrangement adapted to detect a presence of one or more objects, in a first predetermined region, and adapted to turn a fluid flow on when the one or more objects is present, and further adapted to turn the fluid flow off when the object is removed, the fluid flow coming from an outlet in the faucet and into a basin; and a second sensing arrangement adapted to detect a presence and/or a movement of one or more objects, in a second predetermined region and adapted to adjust a temperature of the fluid based on the presence, or movement of the one or more objects, the second predetermined region being located to at least one side of the outlet, and over an area defined by a perimeter of the basin.

2. The faucet of claim 1 wherein the one or more objects is one or both hands of a user.

3. The faucet of claim 1 wherein the a second sensing arrangement includes a first proximity sensor and a second proximity sensor, the first proximity sensor coupled with a mixing valve adapted to adjust the mixing valve such that the fluid will increase in temperature, the second proximity sensor coupled with the mixing valve and further adapted to adjust the mixing valve such that the fluid will decrease in temperature.

4. The faucet of claim 3 wherein the first proximity sensor is located at a first side of a basin, the basin being disposed to receive the fluid, and the second proximity sensor is located at a second side of the basin.

5. The faucet of claim 1 further comprising a control module for adjusting one or more from the group consisting of:

a default temperature;

a maximum temperature;

a minimum time for the fluid flow to remain on upon the removal of the one or more objects from the first predetermined region; and a maximum time for the fluid flow to remain open.

6. The faucet of claim 1 wherein the second sensing arrangement includes a first and a second proximity sensor, the first proximity sensor mounted on a first side of the basin to detect the one or more objects in a first sub region and to increase the temperature of the fluid flow in response to detecting the one or more objects in the first sub region, the second proximity sensor mounted on a second side of the basin to detect the one or more objects in a second sub region and to decrease the temperature of the fluid flow in response to detecting the one or more objects in the second sub region.

7. A method comprising:

reacting to a presence of one or more objects within a first detection zone of a first sensing arrangement by opening a first valve and allowing a mixed fluid to flow from an outlet of a faucet into a basin;

sensing the presence of the one or more objects in a second detection zone located to at least one side of the outlet over the basin; and adjusting a mixing valve based on the presence of the one or more objects to adjust relative components of the mixed fluid to change at least one characteristic of the mixed fluid.

8. The method of claim 7, wherein the mixed fluid is water and the at least one characteristic is the temperature of the water.

9. The method of claim 7, wherein at least one characteristic is one from the group consisting of:

sweetness;

bitterness;

caffeine content;

alcohol content;

acidity; and alkalinity.

10. A water delivery arrangement comprising:

an outlet for outputting a mixed flow;

a mixing valve coupled with a hot water supply and further coupled with a cold water supply, the mixing valve for mixing relative amounts of hot water and cold water, the mixing valve coupled with the outlet for supplying the mixed flow to the outlet;

a main flow valve disposed between the outlet and the mixing valve and adapted to open to allow water to flow from the mixing valve to the outlet or to close to prevent flow to the outlet;

a first sensing arrangement for detecting the presence of an object in a first detection zone and operatively coupled to the main flow valve for effecting the opening and the closing of the main flow valve; and a second sensing arrangement for detecting the presence of the object or another object in a second detection zone located to one side of the outlet and operatively coupled with the mixing valve to effect the mixing of the relative amounts.

11. The water delivery arrangement of claim 10 further comprising a control module coupled with the mixing valve and the main valve for controlling one or more operating conditions of the water delivery arrangement.

12. The water delivery arrangement of claim 10, wherein the operating conditions are one or more from the group consisting of:

a default temperature;

a maximum temperature;

a minimum time for the first valve to remain open to allow water to flow to the outlet upon detection of the presence of the one or more objects; and a maximum time for the main flow valve to remain open.

* * * * *